US007456574B2

(12) United States Patent
Hong et al.

(10) Patent No.: US 7,456,574 B2
(45) Date of Patent: Nov. 25, 2008

(54) PLASMA DISPLAY PANEL HAVING DISCHARGE ELECTRODES EXTENDING OUTWARD FROM DISPLAY REGION

(75) Inventors: Chong-Gi Hong, Suwon-si (KR); Eun-Gi Heo, Suwon-si (KR); Jung-Tae Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 332 days.

(21) Appl. No.: 11/229,528

(22) Filed: Sep. 20, 2005

(65) Prior Publication Data

US 2006/0145609 A1 Jul. 6, 2006

(30) Foreign Application Priority Data

Oct. 12, 2004 (KR) ..... 10-2004-0081347

(51) Int. Cl.
*H01J 17/49* (2006.01)
*G09F 9/313* (2006.01)

(52) U.S. Cl. ..... 313/583; 313/582

(58) Field of Classification Search ..... 313/582–587
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
RE37,444 E 11/2001 Kanazawa
6,630,916 B1 10/2003 Shinoda (Continued)

FOREIGN PATENT DOCUMENTS

JP 2845183 10/1998

(Continued)

OTHER PUBLICATIONS

Korean Office Action of the Korean Patent Application No. 2004-81347, issued on May 17, 2006.

(Continued)

*Primary Examiner*—Joseph L. Williams
*Assistant Examiner*—Bumsuk Won
(74) *Attorney, Agent, or Firm*—Robert E. Bushnell, Esq.

(57) ABSTRACT

A Plasma Display Panel (PDP) includes: a first substrate; a second substrate arranged parallel to the first substrate; and a plurality of discharge electrodes arranged within each discharge cell arranged between the first and second substrates. The first and second substrates are divided into a display region adapted to display an image, a connection region where the plurality of discharge electrodes are adapted to be electrically connected to an external terminal, and a buffer region arranged along edges of the connection region. The plurality of discharge electrodes continuously extend over the display region, the connection region, and the buffer region, and a cross-section of a portion of each of the plurality of discharge electrodes arranged in the buffer region is greater than that of a portion of each of the plurality of discharge electrodes arranged in the connection region.

4 Claims, 7 Drawing Sheets

U.S. PATENT DOCUMENTS

| | | | | |
|---|---|---|---|---|
| 6,707,436 | B2 | 3/2004 | Setoguchi et al. | |
| 2002/0089285 | A1* | 7/2002 | Nishiki et al. | 313/583 |

FOREIGN PATENT DOCUMENTS

| | | |
|---|---|---|
| JP | 2917279 | 4/1999 |
| JP | 11-297216 | 10/1999 |
| JP | 2001-043804 | 2/2001 |
| JP | 2001-229839 | 8/2001 |
| JP | 2001-325888 | 11/2001 |
| JP | 2002-373596 | 12/2002 |
| JP | 2003-338249 | 11/2003 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Office action from the Japanese Patent Office issued in Applicant's corresponding Japanese patent Application No. 2005-205932 dated Jun. 27, 2008.

* cited by examiner

FIG. 2A
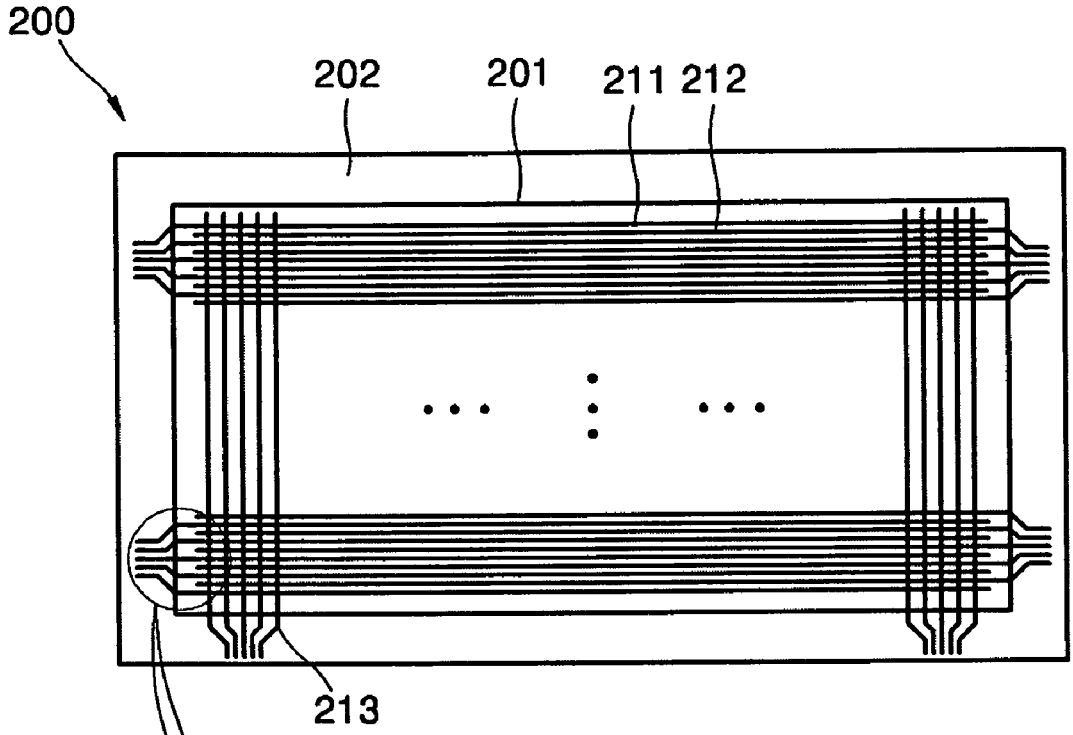
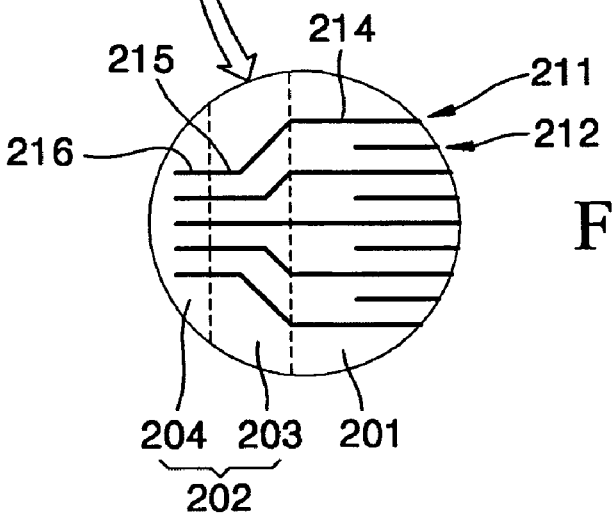
FIG. 2B

FIG. 5A
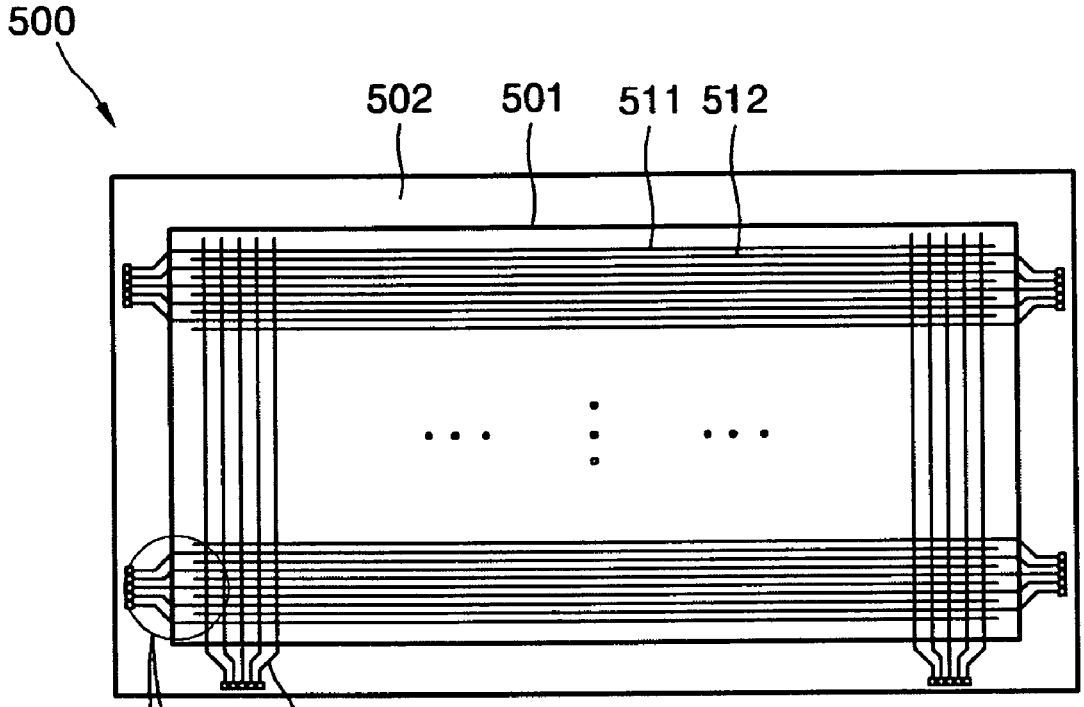
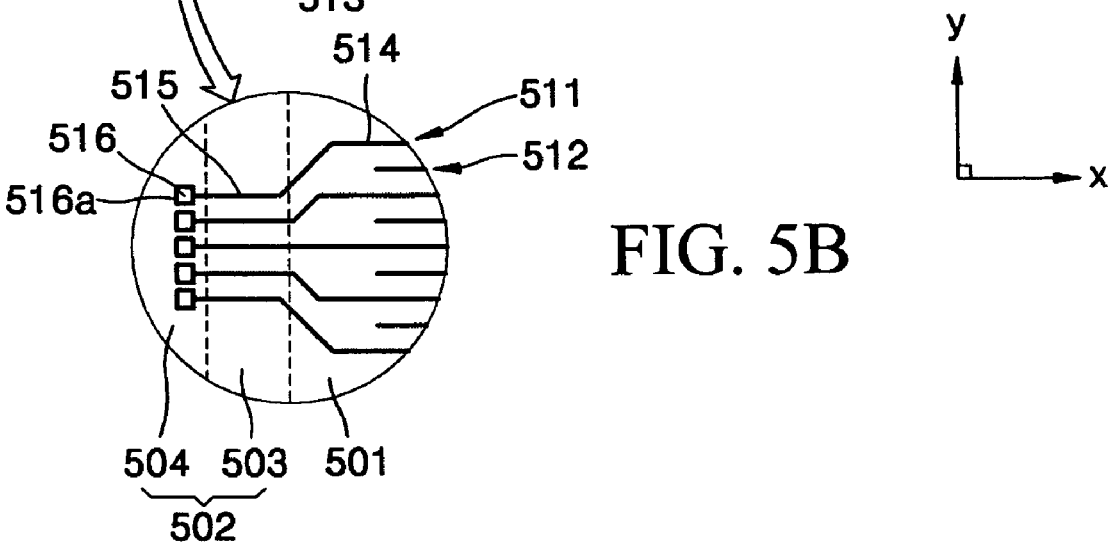
FIG. 5B

PLASMA DISPLAY PANEL HAVING DISCHARGE ELECTRODES EXTENDING OUTWARD FROM DISPLAY REGION

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 12 Oct., 2004 and there duly assigned Serial No. 10-2004-0081347.

BACKGROUND OF THE INVENTION

1. Field of the Invention

The present invention relates to a Plasma Display Panel (PDP), and more particularly, to a PDP with an improved structure of discharge electrodes extending outward from a display region on which images are shown.

2. Description of the Related Art

In general, Plasma Display Panels (PDPs) are flat panel display devices in which a discharge gas is sealed after it is injected into a space between two substrates facing each other, on which a plurality of discharge electrodes are formed, a discharge voltage is applied to the PDP, and an appropriate pulse voltage is applied when a gas is emitted between two electrodes due to the discharge voltage to address points where the two electrodes cross, thereby displaying desired numbers, characters, or graphics.

A PDP includes a front substrate, a rear substrate, X and Y electrodes patterned on an inner surface of the front substrate, a front dielectric layer covering the X and Y electrodes, a protective layer formed on a inner surface of the front dielectric layer, address electrodes patterned on an inner surface of the rear substrate, a rear dielectric layer covering the address electrodes, barrier ribs arranged between the front and rear substrates, and a phosphor layer formed on inner walls and floors of the barrier ribs.

In the PDP constructed as above, when an electrical signal is supplied between the address electrodes and the Y electrode, a discharge cell from which light is to be emitted is selected, and when a signal is alternately supplied to the X and Y electrodes, visible light is emitted from the phosphor layer coated in the selected discharge cell, thereby forming a still image or a moving image. These X and Y electrodes 103 and 104 and the address electrodes 107 are driven by a circuit.

The X and Y electrodes are arranged on a substrate facing each other and address electrodes are arranged to cross the X and Y electrodes.

The substrate can be divided into a display region on which an image is displayed and a non-display region surrounding the outer region of the display regions. The non-display region can be further divided into connection regions at which the discharge electrodes are connected to an external terminal and buffer regions for securing enough space for the discharge electrodes to be connected to the external terminal.

Each of the X electrodes is composed of a portion arranged in the display region, a portion arranged in the connection region by extending from the portion as a single body, and a region arranged in the buffer region by extending from the connection region as a single body.

If the buffer region does not exist, a serious digging of the X electrode occurs when developing the X electrode. Consequently, it becomes difficult to secure the proper length of the X electrode in the connection region.

The discharge electrode is arranged on a substrate. The substrate is divided into a display region, a connection region, and a buffer region.

The discharge electrode includes transparent electrode lines, and bus electrode lines formed on the transparent electrode lines. The bus electrode lines include a portion arranged in the display region, a portion arranged in the connection region, and a portion arranged in the buffer region.

However, an end of the portion arranged in the buffer region can split during a manufacturing process due to its narrow width. If the end splits, the end becomes separated later due to the force created when the bus electrode lines and an external terminal are connected in the connection region, thereby causing a short with a peripheral terminal.

SUMMARY OF THE INVENTION

The present invention provides a PDP with enlarged ends of discharge electrodes so that the ends connected to an external terminal do not split.

According to an aspect of the present invention, a Plasma Display Panel (PDP) is provided including: a first substrate; a second substrate arranged parallel to the first substrate; and a plurality of discharge electrodes arranged within each discharge cell arranged between the first and second substrates; wherein the first and second substrates are divided into a display region adapted to display an image, a connection region wherein the plurality of discharge electrodes are adapted to be electrically connected to an external terminal, and a buffer region arranged along edges of the connection region, and wherein the plurality of discharge electrodes continuously extend over the display region, the connection region, and the buffer region, and wherein a cross-section of a portion of each of the plurality of discharge electrodes arranged in the buffer region is greater than that of a portion of each of the plurality of discharge electrodes arranged in the connection region.

A width of the portion of each of the plurality of discharge electrodes arranged in the buffer region is greater than widths of the portions of each of the plurality of discharge electrodes arranged in the display region and the connection region.

A a length of the portion of each of the plurality of discharge electrodes arranged in the connection area is greater than a length of the portion of each of the plurality of discharge electrodes arranged in the buffer region.

A width of the portion of each of the plurality of discharge electrodes arranged in the display region is equal to a width of the portion of each of the plurality of discharge electrodes arranged in the connection region.

Each of the plurality of discharge electrodes arranged in the display region includes a dual structure including a bus electrode line arranged on the transparent electrode line.

Each of the plurality of discharge electrodes arranged in the connection region and the buffer region includes a single structure including an extension of the bus electrode line.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein:

FIGS. 2A and 2B together form a plane view of a portion of discharge electrodes;

FIGS. 5A and 5B together form a plane view of a portion of discharge electrodes according to another embodiment of the present invention;

DETAILED DESCRIPTION OF THE INVENTION

Figure 1:
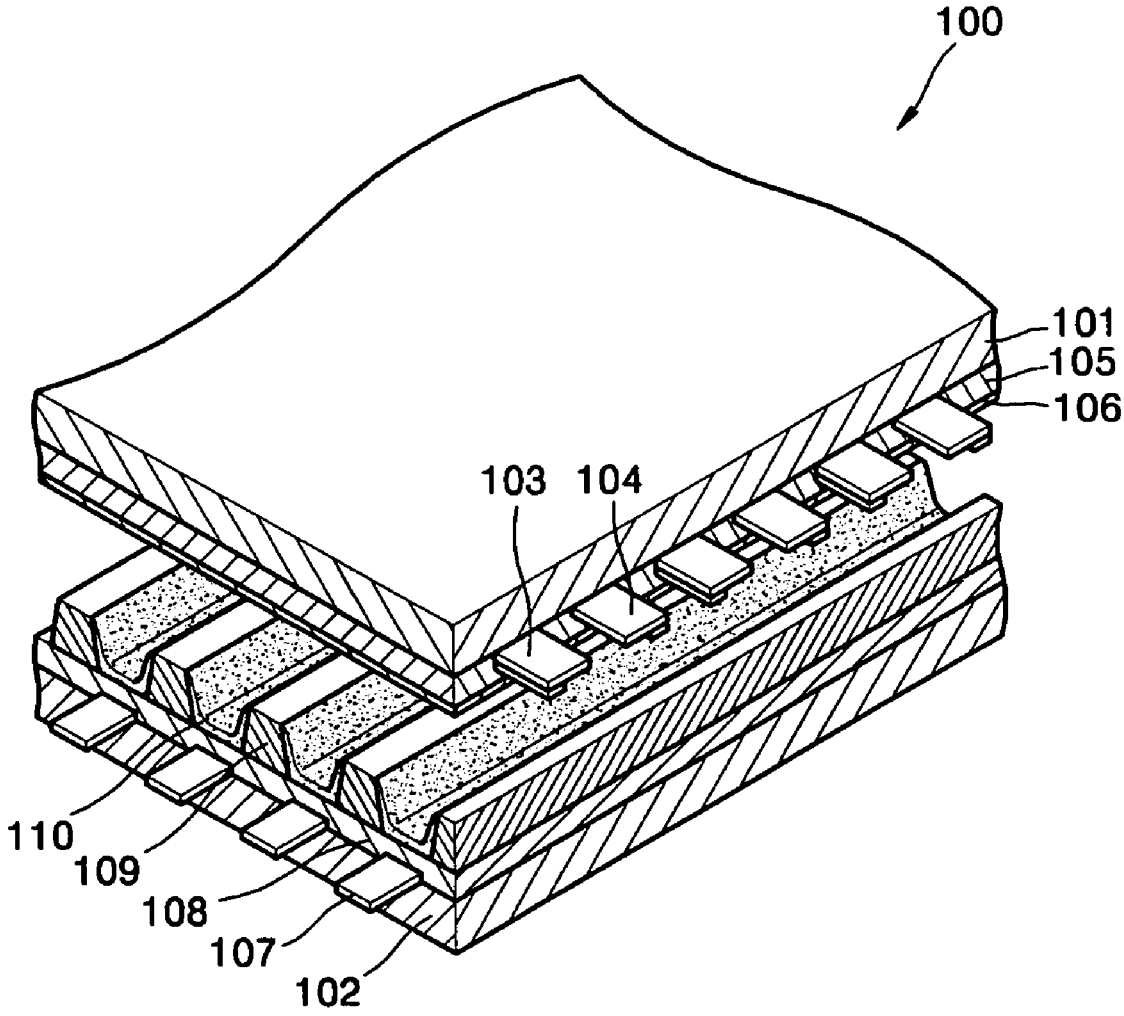
FIG. 1 is an exploded perspective view of a portion of a PDP.

Referring to FIG. 1, a PDP 100 includes a front substrate 101, a rear substrate 102, X and Y electrodes 103 and 104 patterned on an inner surface of the front substrate 101, a front dielectric layer 105 covering the X and Y electrodes 103 and 104, a protective layer 106 formed on a inner surface of the front dielectric layer 105, address electrodes 107 patterned on an inner surface of the rear substrate 102, a rear dielectric layer 108 covering the address electrodes 107, barrier ribs 109 arranged between the front and rear substrates 101 and 102, and a phosphor layer 110 formed on inner walls and floors of the barrier ribs 109.

In the PDP constructed as above, when an electrical signal is supplied between the 11 address electrodes 107 and the Y electrode 104, a discharge cell from which light is to be emitted is selected, and when a signal is alternately supplied to the X and Y electrodes 103 and 104, visible light is emitted from the phosphor layer 110 coated in the selected discharge cell, thereby forming a still image or a moving image. These X and Y electrodes 103 and 104 and the address electrodes 107 are driven by a circuit.

FIGS. 2A and 2B together form a diagram of an arrangement of X and Y electrodes 211 through 212.

Referring to FIGS. 2A and 2B, on a substrate 200, the X and Y electrodes 211 and 212 are arranged facing each other and address electrodes 213 are arranged to cross the X and Y electrodes 211 and 212.

The substrate 200 can be divided into a display region 201 on which an image is displayed and a non-display region 202 surrounding the outer region of the display regions 201. The non-display region 202 can be further divided into connection regions 203 at which the discharge electrodes 211 through 213 are connected to an external terminal and buffer regions 201 for securing enough space for the discharge electrodes 211 through 213 to be connected to the external terminal.

Describing in more detail with the X electrode 211 as an example, each of the X electrodes 211 is composed of a portion 214 arranged in the display region 201, a portion 215 arranged in the connection region 203 by extending from the portion 214 as a single body, and a region 216 arranged in the buffer region 204 by extending from the connection region 203 as a single body.

The length of the X electrode 211 arranged in the connection region 203 needs to be about 4 mm in order to be connected to the external terminal, for example, a flexible printed cable.

In order to secure enough length of the X electrode 211 to be connected to the external terminal, the length of the X electrode 211 arranged in the buffer region 204 needs to be at least 2 mm. Only then can the length of the X electrode 211 in the connection region 203 be formed to be about 4 mm.

If the buffer region 204 does not exist, a serious digging of the X electrode 211 occurs when developing the X electrode 211. Consequently, it becomes difficult to secure the length of the X electrode 211 in the connection region 203 to be 4 mm.

Figure 3:
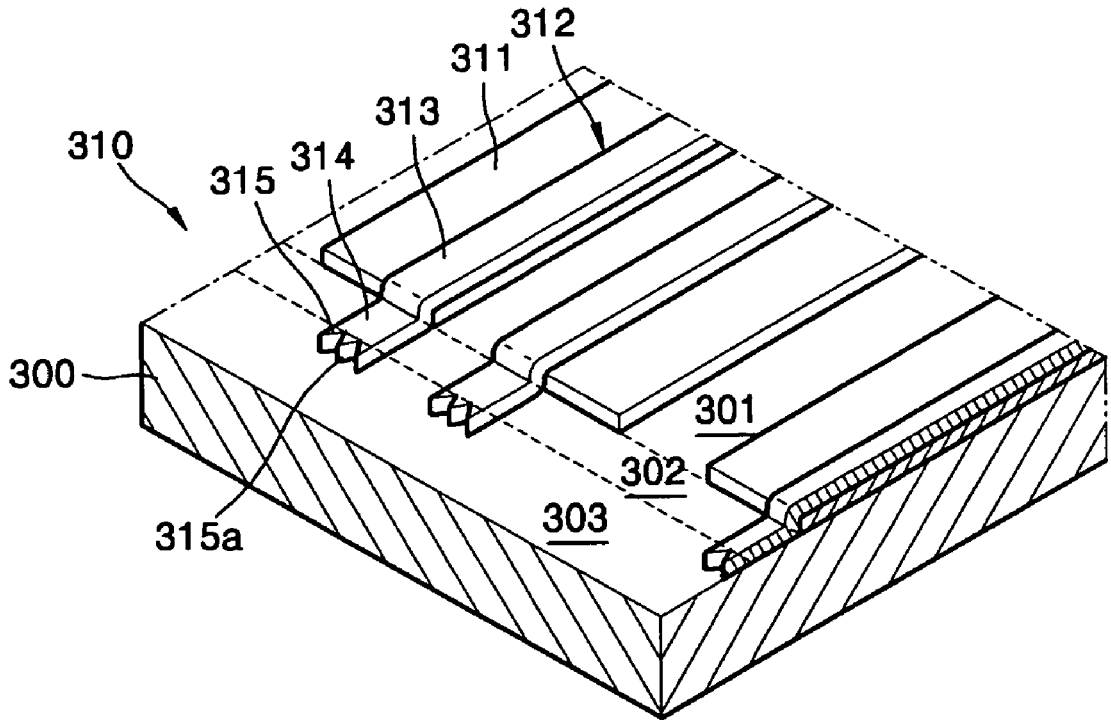
FIG. 3 is a perspective view of a discharge electrode.

FIG. 3 is an enlarged view of a discharge electrode 310 in a buffer region 303.

Referring to FIG. 3, the discharge electrode 310 is arranged on a substrate 300. The substrate 300 is divided into a display region 301, a connection region 302, and a buffer region 303.

The discharge electrode 310 includes transparent electrode lines 311, and bus electrode lines 312 formed on the transparent electrode lines 311. The bus electrode lines 312 include a portion 313 arranged in the display region 301, a portion 314 arranged in the connection region 302, and a portion 315 arranged in the buffer region 303.

However, an end 315*a* of the portion 315 arranged in the buffer region 303 can split during a manufacturing process due to its narrow width. If the end 315*a* splits, the end 315*a* becomes separated later due to the force created when the bus electrode lines 312 and an external terminal are connected in the connection region 302, thereby causing a short with a peripheral terminal.

A PDP of the present invention is described more fully below with reference to the accompanying drawings, in which exemplary embodiments of the present invention are shown.

Figure 4:
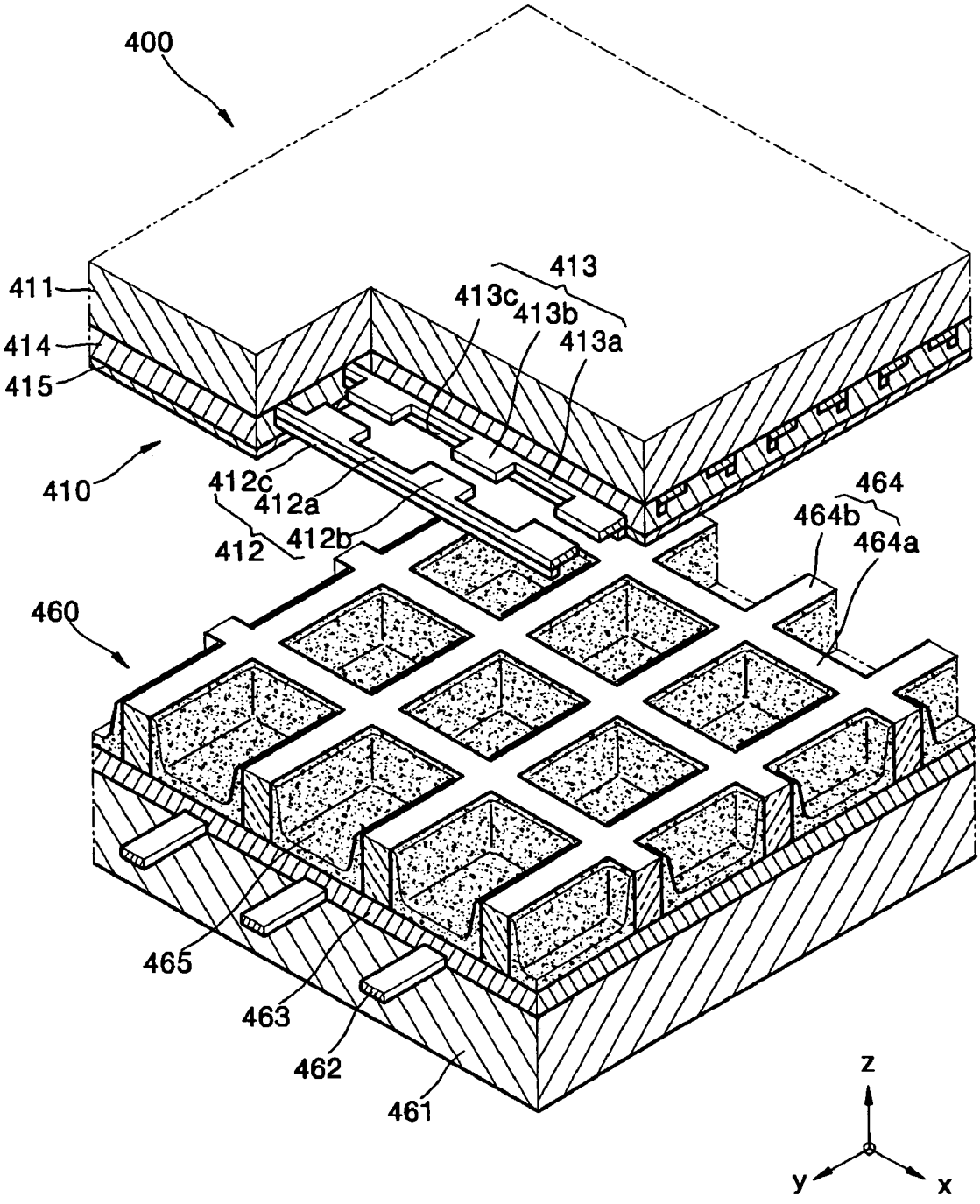
FIG. 4 is an exploded perspective view of a portion of a PDP according to a first embodiment of the present invention.

FIG. 4 is an exploded perspective view of a portion of a PDP 400 according to an embodiment of the present invention.

Referring to FIG. 4, the PDP 400 includes a front panel 410 and a rear panel 460 arranged parallel to the front panel 410.

The front panel 410 includes a front substrate 411. The front substrate 411 is a transparent substrate, such as a soda lime glass. On a bottom surface of the front substrate 411, X and Y electrodes 412 and 413 are alternately arranged inside the discharge cells along the X direction of the PDP 400.

The X electrodes 412 include first transparent electrode lines 412*a* in strips, first protrusions 412*b* protruding from the first transparent electrode lines 412*a* toward the Y electrodes 413, and first bus electrode lines 412*c* formed on the first transparent electrode lines 412*a*.

The Y electrodes 413 include second transparent electrode lines 413*a* in strips, second protrusions 413*b* protruding from the second transparent electrode lines 413*a* toward the Y electrodes 413, and second bus electrode lines 413*c* formed on the second transparent electrode lines 412*a*.

The first and second transparent electrode lines 412*a* and 413*a* and the first and second protrusions 412*b* and 413*b* are formed from a transparent conductive layer, such as an Indium Tin Oxide (ITO) film, and can be formed from materials having an excellent conductivity, such as an Ag paste or a Cr—Cu—Cr alloy, to reduce the electrical resistance of the first and second transparent electrode lines 412*a* and 413*a*.

The X and Y electrodes 412 and 413 are covered by a front dielectric layer 414. The front dielectric layer 414 can be selectively printed on portions where the X and Y electrodes 412 and 413 are arranged, or can be printed on the entire front substrate 411. A protective layer 415, such as MgO, is coated on an inner surface of the front substrate 411.

The rear panel 460 includes a rear substrate 461. The rear substrate 461 is arranged parallel to the front substrate 411. The rear substrate 461 is also a transparent glass substrate, such as a soda lime glass.

On the rear substrate 461, address electrodes 462 are arranged in strips along the Y direction of the PDP 400. The address electrodes 462 are arranged to cross the X and Y electrodes 412 and 413. The address electrodes 462 extend to traverse adjacent discharge cells. The address electrodes 462 are covered by a rear dielectric layer 463.

Barrier ribs 464 are arranged between the front and rear panels 410 and 460 to partition a discharge space and to prevent cross-talk between adjacent discharge cells. The barrier ribs 464 include first barrier ribs 464*a* arranged to perpendicularly cross the address electrodes 462 and second barrier ribs 464*b* arranged parallel to the address electrodes 462. The first barrier ribs 464*a* extend perpendicularly to the second barrier ribs 464*b*. A matrix is formed when the first and second barrier ribs 464*a* and 464*b* are attached.

Alternatively, the barrier ribs 464 can be formed as a meander type, a delta type, a honeycomb type, etc, and cross-sections of discharge cells partitioned in these different types are not limited to a quadrangle, a polygon, or a circle.

Red, green, and blue phosphor layers 465 are coated inside the barrier ribs 464 of the discharge cells. The phosphor layers 465 can be coated on any portion of the discharge cells, and in the present embodiment, the phosphor layers 465 are coated on inner walls and floors of the barrier ribs 464.

The phosphor layers 465 are coated in the discharge cells. The red phosphor layers 465 can be made of (Y, Gd) $BO_3$:$Eu^{+3}$, the green phosphor layers 465 can be made of $Zn_2SiO_4$:$Mn^{2+}$, and the blue phosphor layers 465 can be made of $BaMgAl_{10}O_{17}$:$Eu^{2+}$.

In the PDP 400 constructed as above, one of the discharge cells is selected by supplying an electrical signal to the Y electrode and the address electrodes 413 and 462. Ultraviolet (UV) rays are generated as a surface discharge occurs from a surface of the front panel 410 by alternately supplying electrical signals to the X and Y electrodes 412 and 413, and a still image or a moving image is displayed by visible light emitted from the phosphor layers 465 of the selected discharge cell.

Discharge electrodes, which are X and Y electrodes 412 and 413, are continuously arranged on a display region at which an image is displayed, a connection region at which the discharge electrodes are connected to an external terminal, and a buffer region extending outwards from the exterior of the connection region. An area of the discharge electrodes arranged in the buffer region is relatively larger than areas of the discharge electrodes arranged in the display region or the connection region.

FIGS. 5A and 5B together form a plane view of an arrangement of first and second discharge electrodes 511 and 512 according to another embodiment of the present invention.

Referring to FIGS. 5A and 5B, the first and second discharge electrodes 511 and 512 are alternately arranged on a substrate 500. A pair of the first and second discharge electrodes 511 and 512 is arranged in each discharge cells.

Since the PDP is a three-electrode AC surface discharge panel in the present embodiment, the first and second discharge electrodes 511 and 512 denote X and Y electrodes which cause a display sustain discharge, and address electrodes 513 can be further arranged to perpendicularly cross the first and second discharge electrodes 511 and 512. Although, the first and second discharge electrodes 511 and 512 are multi-electrodes with at least two electrodes, the present invention is not limited to the multi-electrodes depending on a DC type, a hybrid type, or a facing discharge type panel.

The substrate 500 can be divided into a display region 501 on which an image is displayed, and a non-display region 502 formed along edges of the display region 501.

The non-display region 502 can be further divided into a connection region 503 at which the first and second discharge electrodes 511 and 512 are connected to an external terminal, such as a flexible printed cable, and buffer regions 504 for securing enough space for the discharge electrodes 511 through 512 to be connected to the external terminal.

The first and second discharge electrodes 511 and 512 are continuously arranged from the display region 501 to the buffer regions 504 via the connection regions 503.

Since the first and second discharge electrodes 511 and 512 arranged facing each other actually have the same structure, only the first discharge electrodes 511 are described below.

Each of the first discharge electrodes 511 is composed of a portion 514 arranged in the display region 501, a portion 515 arranged in the connection region 503 by extending from the portion 514 as a single body, and a region 516 arranged in the buffer region 504 by extending from the connection region 503 as a single body.

A cross-section of the portion 516 arranged in the buffer region 504 is larger than a cross-section of the portion 514 arranged in the display region 501 or a cross-section of the portion 515 arranged in the connection region 503. This prevents an end 516*a* of the portion 516 arranged in the buffer region 504 from splitting.

Also, the length of the portion 515 arranged in the connection region 503 is formed to be relatively longer than that of the portion 516 arranged in the buffer region 504. It is advantageous for the portion 515 arranged in the connection region 503 to have a larger contact area since the portion 515 is actually connected to an external terminal such as a flexible printed cable. However, it is advantageous for the portion 516 arranged in the buffer region 504 extending from the portion 515 arranged in the connection region 503 for securing enough space for the portion 515 arranged in the connection region 503 to be relatively short so that the size of the substrate 500 can be compact and thin.

A width of the portion 514 arranged in the display region 501 can actually be the same as a width of the portion 515 arranged in the connection region 502.

Figure 6:
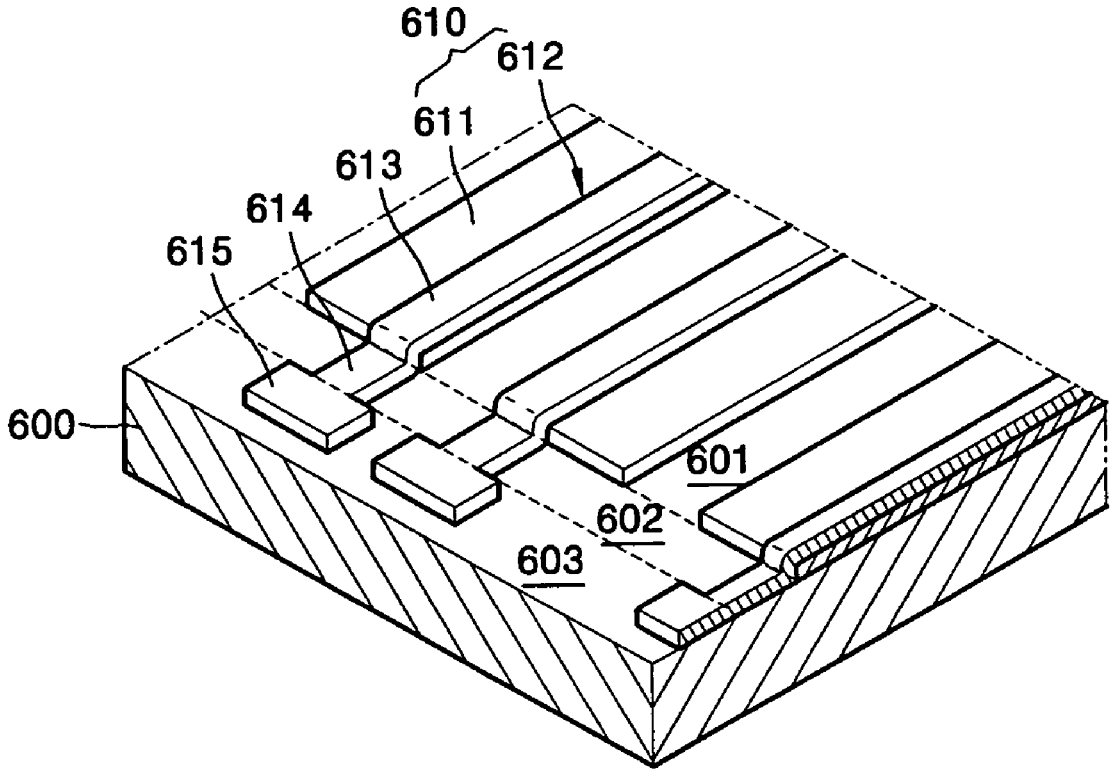
FIG. 6 is a perspective view of discharge electrodes according to yet another embodiment of the present invention.

FIG. 6 is a perspective view of discharge electrodes 610 according to another embodiment of the present invention.

Referring to FIG. 6, the discharge electrodes 610 are arranged on a substrate 600.

The substrate 600 can be divided into a display region 601, a connection region 602 extending outwards from the display region 601, and a buffer region 603 extending outwards from the connection region 602.

Each of the discharge electrodes 610 includes a transparent electrode line 611 arranged in the display region 601. A pair of transparent electrode lines 611 is arranged in each discharge cell in the display region 601, and different discharge voltages are supplied to the pair of transparent electrodes lines 611 arranged within the discharge cell. In addition, it is advantageous for the transparent electrode lines 611 to be formed of a transparent conductive layer, for example an ITO film, because this prevents a reduction of the aperture ratio.

Bus electrode lines 612 are each arranged on an end of the transparent electrode line 611 to improve the electrical conductivity of the transparent electrode line 613. The bus electrode line 612 has a dual structure in the display region 601 in which the bus electrode line 612 is formed on the transparent electrode line 611, and has a single structure in the connection region 602 and the buffer region 603 extending from the display region 601. Also, the bus electrode line 612 is formed in strips in which a portion 613 arranged in the display region 601, a portion 614 arranged in the connection region 602, and a portion 615 arranged in the buffer region 603 are connected as a single body.

A width of the portion 615 arranged in the buffer region 603 is relatively wider than those of the portions 613 and 614 respectively arranged in the display region 601 and the connection region 602. Accordingly, an area of the portion 615 arranged in the buffer region 603 is also larger. In addition, the portions 613 and 614 respectively arranged in the display region 601 and the connection region 602 can actually have the same widths.

Figure 7:
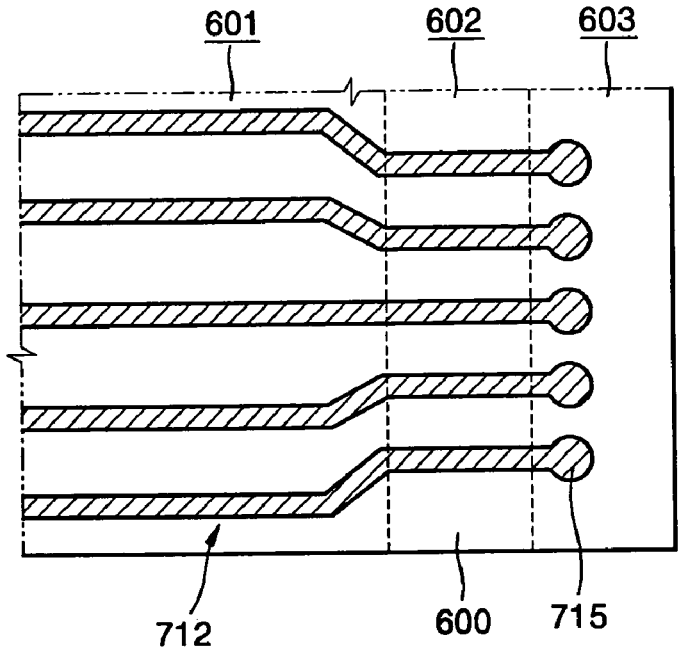
FIG. 7 is a plane view of discharge electrodes according to still another embodiment of the present invention.
Figure 8:
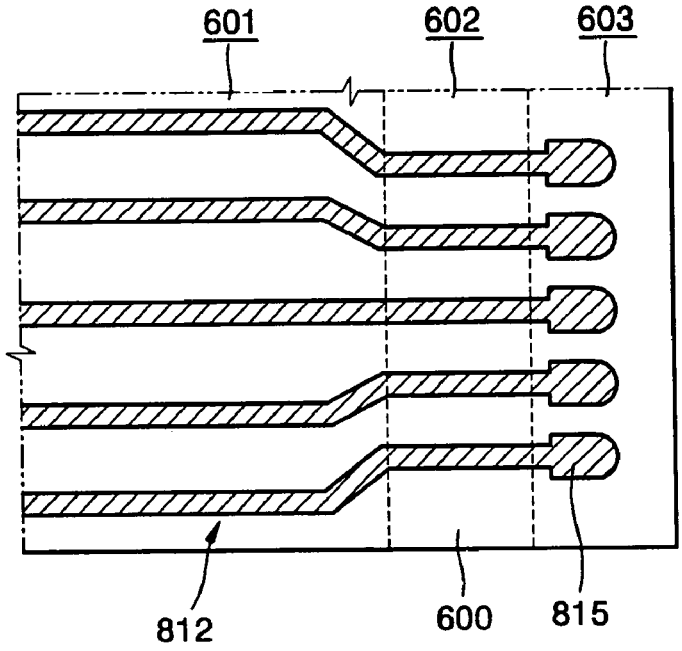
FIG. 8 is a plane view of discharge electrodes according to yet another embodiment of the present invention

The shape of the portion 615 arranged in the buffer region 603 is not limited to the rectangle illustrated in FIG. 6. Also, the shapes of portions 715 and 815 arranged in buffer regions 603 are not limited to the circles or non-circles respectively illustrated in FIGS. 7 and 8.

The portion 615 arranged in the buffer region 603 is intentionally formed to prevent left and right digging of the portion 64 arranged in the connection region 602 during a process for forming a pattern of the bus electrode line 612, for example, a developing process. Therefore, the length of the portion 615 arranged in the buffer region 603 does not need to be longer than that of the portion 614 arranged in the connection area 612.

A PDP as described above has the following effects.

Firstly, by forming a portion of a discharge electrode extending outwards from a portion at which the discharge electrode is connected to an external terminal as a single body and at the same time, by forming a portion of the discharge electrode with an enlarged area, a desired shape can be obtained at a portion connected to the external terminal when forming the discharge electrode.

Secondly, short defects can be prevented since the splitting of the ends of the discharge electrodes are prevented by the discharge electrodes having enlarged areas.

Lastly, by securing a portion of the discharge electrode at which the discharge electrode is connected to the external terminal, an inner voltage of the PDP can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A Plasma Display Panel (PDP), comprising:

a first substrate;

a second substrate arranged parallel to the first substrate; and a plurality of discharge electrodes arranged within each discharge cell arranged between the first and second substrates;

wherein the first and second substrates are divided into a display region adapted to display an image, a connection region wherein the plurality of discharge electrodes are adapted to be electrically connected to an external terminal, and a buffer region arranged along edges of the connection region;

wherein the plurality of discharge electrodes continuously extend over the display region, the connection region, and the buffer region, and wherein a cross-section of a portion of each of the plurality of discharge electrodes arranged in the buffer region is greater than that of a portion of each of the plurality of discharge electrodes arranged in the connection region;

wherein a length of the portion of each of the plurality of discharge electrodes arranged in the connection area is greater than a length of the portion of each of the plurality of discharge electrodes arranged in the buffer region; and wherein a width of the portion of each of the plurality of discharge electrodes arranged in the display region is equal to a width of the portion of each of the plurality of discharge electrodes arranged in the connection region.

2. The PDP of claim 1, wherein a width of the portion of each of the plurality of discharge electrodes arranged in the buffer region is greater than widths of the portions of each of the plurality of discharge electrodes arranged in the display region and the connection region.

3. The PDP of claim 1, wherein each of the plurality of discharge electrodes arranged in the display region comprises a dual structure including a bus electrode line arranged on the transparent electrode line.

4. The PDP of claim 3, wherein each of the plurality of discharge electrodes arranged in the connection region and the buffer region comprises a single structure including an extension of the bus electrode line.

* * * * *